US005860650A

United States Patent [19]

Scobbie et al.

[11] Patent Number: 5,860,650

[45] Date of Patent: Jan. 19, 1999

[54] THREE DIMENSIONAL PUZZLE

[75] Inventors: Gavin Scobbie, Homewood; Thomas P. McQueeny, Chicago, both of Ill.

[73] Assignee: Distribution Muralex Inc., Mount-Royal, Canada

[21] Appl. No.: 827,245

[22] Filed: Mar. 28, 1997

Related U.S. Application Data

[63] Continuation of Ser. No. 638,310, Apr. 26, 1996, abandoned, which is a continuation of Ser. No. 432,004, May 1, 1995, abandoned, which is a continuation of Ser. No. 147,052, Nov. 3, 1993, abandoned.

[51] Int. Cl.[6] ..... A63F 9/12

[52] U.S. Cl. ..... 273/157 R

[58] Field of Search ..... 273/157 R, 153 R; 446/109, 110

[56] References Cited

U.S. PATENT DOCUMENTS

| | | | |
|---|---|---|---|
| 2,569,107 | 9/1951 | Johnson . | |
| 3,334,798 | 8/1967 | Pezely, Jr. et al. | 273/157 R |
| 3,485,496 | 12/1969 | Brunton | 273/157 R |
| 3,701,214 | 10/1972 | Sakamoto . | |
| 4,357,744 | 11/1982 | McKenzie et al. | 446/109 |
| 4,365,454 | 12/1982 | Davis | 446/109 |
| 4,530,196 | 7/1985 | O'Bryan | 446/109 |
| 4,824,112 | 4/1989 | Roy . | |
| 4,874,341 | 10/1989 | Ziegler | 446/109 |
| 5,251,900 | 10/1993 | Gallant . | |

FOREIGN PATENT DOCUMENTS

| | | | |
|---|---|---|---|
| 2050969 | 3/1993 | Canada . | |
| 186873 | 10/1936 | Switzerland | 446/109 |

OTHER PUBLICATIONS

"Bits and Pieces—The Great International Puzzle Collection" catalog; pp. 2, 5, 17, 19, 20 and 25.

*Primary Examiner*—Steven Wong
*Attorney, Agent, or Firm*—Morrison & Foerster LLP

[57] ABSTRACT

In order to enhance the enjoyment of assembling a puzzle of the three-dimensional type, a puzzle is disclosed in the form of a building-like structure having walls to be joined at corners thereof. The puzzle includes a plurality of wall pieces capable of interlocking in a plane to form walls of the building-like structure. It is also contemplated that each of the wall pieces will have peripheral male and female contours capable of interlocking engagement to form a portion of a wall. The puzzle further includes at least one corner piece capable of joining a pair of walls at a corner of the building-like structure. It is also contemplated that the corner piece will be formed so as to have a groove in a backing material opposite an image-bearing outer surface of the same types which are also to be used for each of the wall pieces. With this understanding of the components of the puzzle, the groove in the corner piece has a depth dimension sufficient for folding the corner piece to form a corner for the building-like jigsaw puzzle structure.

22 Claims, 3 Drawing Sheets

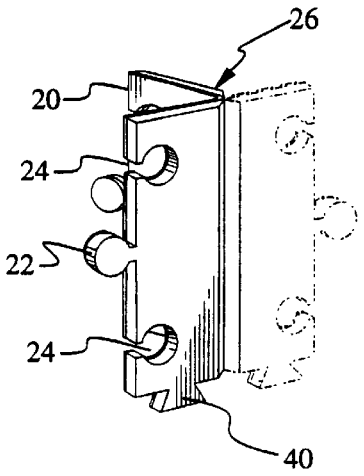
Fig.6
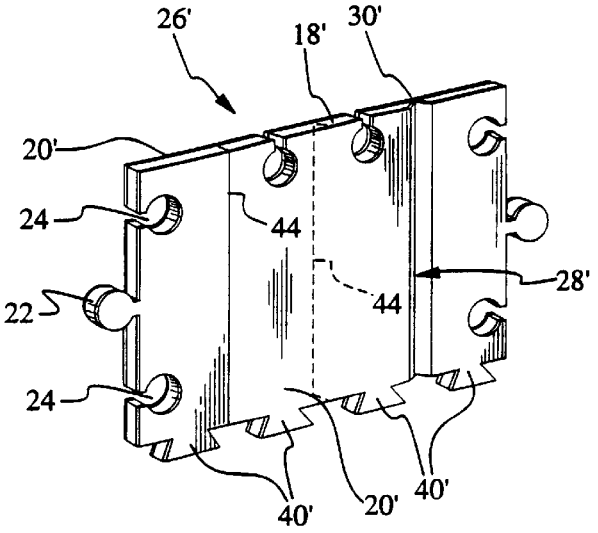
Fig.7
Fig.8
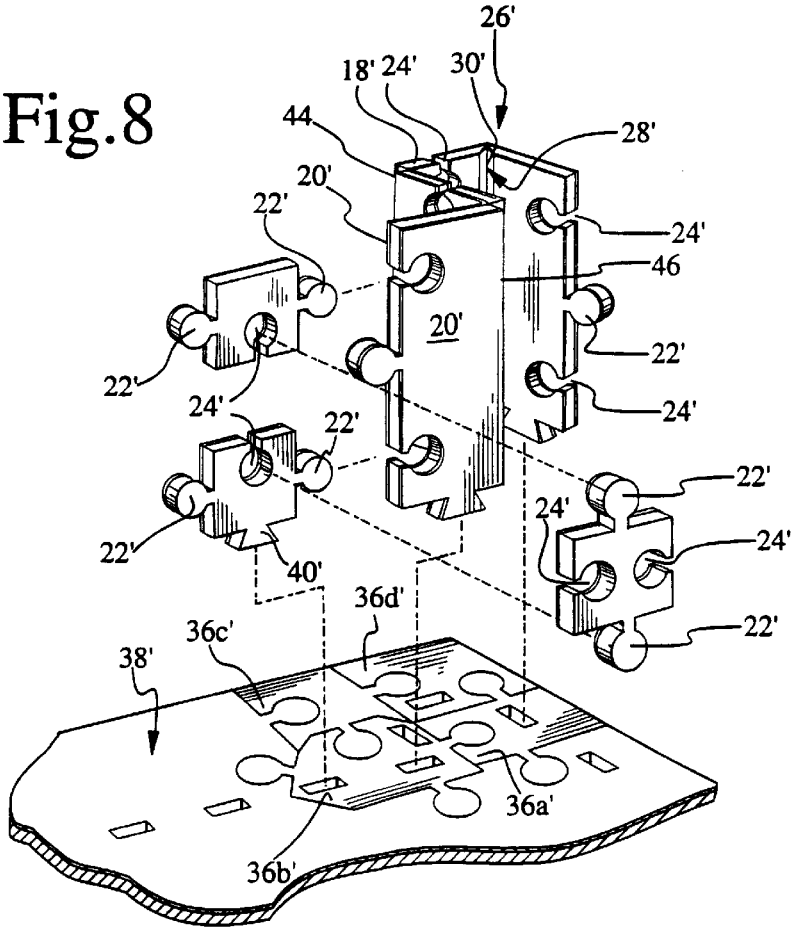

THREE DIMENSIONAL PUZZLE

This application is a continuation of U.S. application Ser. No. 08/638,310, filed Apr. 26, 1996, which was a continuation of U.S. application Ser. No. 08/432,004, filed May 1, 1995, which was a continuation of U.S. application Ser. No 08/147,052, filed Nov. 3, 1993, all now abandoned.

FIELD OF THE INVENTION

The present invention is generally related to entertainment sources, such as games, puzzles and the like, and, more particularly, to a three-dimensional jigsaw puzzle for assembly into a building-like structure.

BACKGROUND OF THE INVENTION

Over the years, there have been a vast number of different entertainment sources generally in the form of games and puzzles. It is particularly noteworthy that jigsaw puzzles have had significant popularity which has spanned generations. Typically, a jigsaw puzzle will include a plurality of two-dimensional puzzle pieces, each having a different and unique portion of an overall image.

As is well known, the puzzle pieces are loosely accumulated in a random order. The puzzle is "solved" by correctly assembling the pieces in expanding, interlocked relation until the entirety of the puzzle has been assembled. As the puzzle is assembled, the image becomes more complete until the entire image fully appears.

More recently, there have developed a number of different types of three-dimensional jigsaw puzzles. These are typically designed to be self-standing structures which have a plurality of walls, each of which essentially comprises a two-dimensional puzzle in and of itself. Further, the three-dimensional jigsaw puzzles often are provided with a two-dimensional puzzle base.

With this form of puzzle, the walls which form the structure must be joined in some effective manner. This is particularly true where the three-dimensional jigsaw puzzle is adapted to be assembled into a building-like structure wherein the walls are to be joined at the corners thereof. In the past, this has simply not been accomplished in a manner that gives a finished appearance.

In this connection, the corners of three-dimensional jigsaw puzzles have had an interrupted image-bearing outer surface. This has diminished enjoyment inasmuch as the aesthetics of the fully-assembled puzzle have lacked the realism of an actual building-like structure. To overcome this problem, Roy U.S. Pat. No. 4,824,112 proposed the utilization of corner pieces that utilize a shoulder-cut rabbet joint.

With this arrangement, the backing material of each corner piece is cut out to permit adhesive joining in a substantially right-angle arrangement. This does achieve the objective of a continuous image-bearing outer surface at the corners, but there are several notable deficiencies. In particular, it is well recognized that there are both structural and aesthetic problems with the corners which have been proposed in Roy U.S. Pat. No. 4,824,112.

More specifically, the corner pieces have a weakness where the backing material has been cut all the way through to the laminated image-bearing outer sheet. This can be particularly critical where, after a considerable amount of play, the adhesive fails, and the corner piece is no longer retained as a substantially right-angle piece. Furthermore, even when the adhesive is performing its intended function, the right-angle corner pieces are less than desirable from an aesthetic viewpoint.

In this regard, the three-dimensional jigsaw puzzle would provide greater enjoyment in the event all of the pieces were initially in a single plane. Thus, it would be highly desirable to have not only the wall pieces but also the corner pieces such that, when the pieces are loosely gathered, they have the initial appearance, at least from viewing the image-bearing outer surface, of all being wall pieces. Thereafter, when properly identified, the corner pieces could be formed by the participants in solving the puzzle into a substantially right angle.

The present invention is directed to overcoming one or more of the foregoing problems and achieving one or more of the resulting objects.

SUMMARY OF THE INVENTION

It is a principal object of the present invention to provide a new and improved three-dimensional jigsaw puzzle construction. It is a further object of the present invention to provide such a unique puzzle which is capable of being assembled into a building-like structure having walls to be joined at corners thereof. It is an additional object of the present invention to provide a corner piece convertible from a plane to a substantially right angle.

Accordingly, the present invention is directed to a new and improved three-dimensional jigsaw puzzle construction capable of being assembled into a building-like structure having walls which are to be joined at the corners thereof. The puzzle includes a plurality of wall pieces capable of interlocking in a plane to form walls of the building-like structure. Each of the wall pieces is formed of a backing material having a thickness dimension which is sufficient for supporting the building-like structure of the three-dimensional jigsaw puzzle when fully assembled. The puzzle also includes the backing material of the wall pieces having an integrally associated image-bearing outer surface thereon. Each of the wall pieces also has peripheral male and female contours capable of interlocking engagement in a plane to form a portion of a wall with complementary male and female contours of adjacent ones of the wall pieces. The puzzle further includes a corner piece capable of joining a pair of walls at each corner of the building-like structure. Each of the corner pieces of the puzzle is also formed of the same backing material as the wall pieces and the corner pieces also have an integrally associated image-bearing outer surface thereon. The corner pieces each have a groove in the backing material on the side opposite the image-bearing outer surface. With these features of construction, the three-dimensional jigsaw puzzle is formed such that the grooves in the corner pieces each have a depth dimension sufficient for folding the corner pieces to form the corners for the building-like structure.

In the exemplary embodiment, each of the corner pieces also have peripheral male and female contours capable of interlocking engagement in the planes of the pair of walls to be joined thereby. It is also advantageous for the grooves to have a depth dimension sufficient for folding the corner pieces to form the corners for the building-like structure as right-angle corners. Still additionally, the depth dimension for the grooves in the corner pieces is preferably sufficient to create fold lines on the image-bearing outer surfaces when folded to form the corners. It is also advantageous for the grooves in the corner pieces to be generally V-shaped in order to define an angle of at least 90° between the intersecting surfaces of the backing material defining the grooves. In the preferred embodiment, the backing material is advantageously formed of a polyethylene foam, and the image-bearing outer surface is preferably formed of a lithographic sheet laminated to the foam.

Also, in the preferred embodiment, the grooves have a depth dimension less than the thickness of the backing material so as to form padded hinges substantially at the point of the fold lines. It is also advantageous for the building-like structure to have at least four walls to be joined at corners, including a plurality of corner pieces for each of the corners of the building-like structure. In a highly preferred embodiment, at least one corner piece is suitably formed to have the fold line defined by the groove and at least one additional fold line defined by a living hinge spaced therefrom.

More specifically, the living hinge defining the additional fold line of the corner piece so formed is preferably defined by a die-cut score through the backing material to the depth of the image-bearing surface thereof. It is advantageous in this respect for at least one corner piece to have a lithographic sheet laminated onto each of the oppositely facing surfaces of the polyethylene foam backing material and to include two additional fold lines. With this arrangement, one of the additional fold lines may define a living hinge operating in one direction, and the other of the additional fold lines may define a living hinge operating in the opposite direction.

In another respect, the three-dimensional jigsaw puzzle advantageously includes a plurality of base pieces capable of interlocking in a plane to form a puzzle base to receive and support the wall pieces and corner pieces. The wall pieces and corner pieces adjacent the puzzle base may then be formed so as to have male dovetail joint elements thereon. With this arrangement, the base pieces forming the puzzle base advantageously have male dovetail joint-receiving openings to lockingly receive the male dovetail joint elements on the wall pieces and the corner pieces.

Other objects, advantages and features of the present invention will become apparent from a consideration of the following specification, taken in conjunction with the accompanying drawings.

BRIEF DESCRIPTION OF THE DRAWINGS

FIG. 6 is a perspective view of a corner piece utilized as either an inside or outside corner;

FIG. 7 is a perspective view of an alternative form of corner piece for puzzles of the general type illustrated in FIG. 1; and FIG. 8 is a perspective view illustrating the manner of assembling a puzzle utilizing the corner piece shown in FIG. 7.

DETAILED DESCRIPTION OF THE PREFERRED EMBODIMENTS

Figure 1:
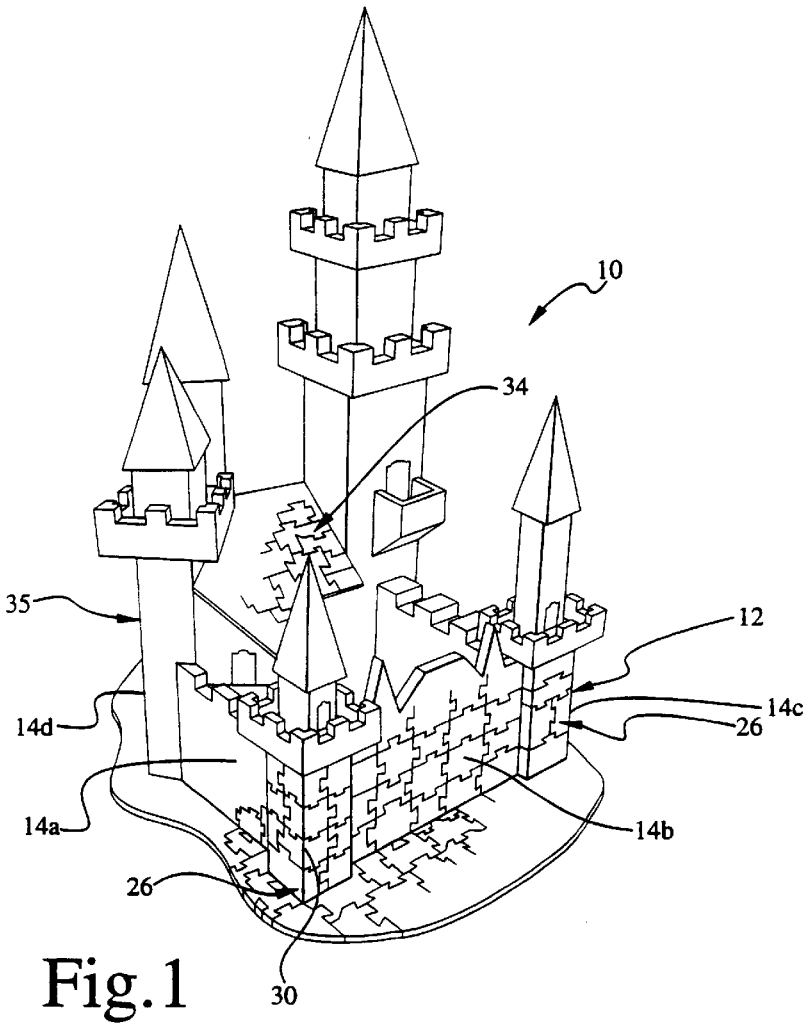
FIG. 1 is a perspective view of a three-dimensional jigsaw puzzle in accordance with the present invention.
Figure 2:
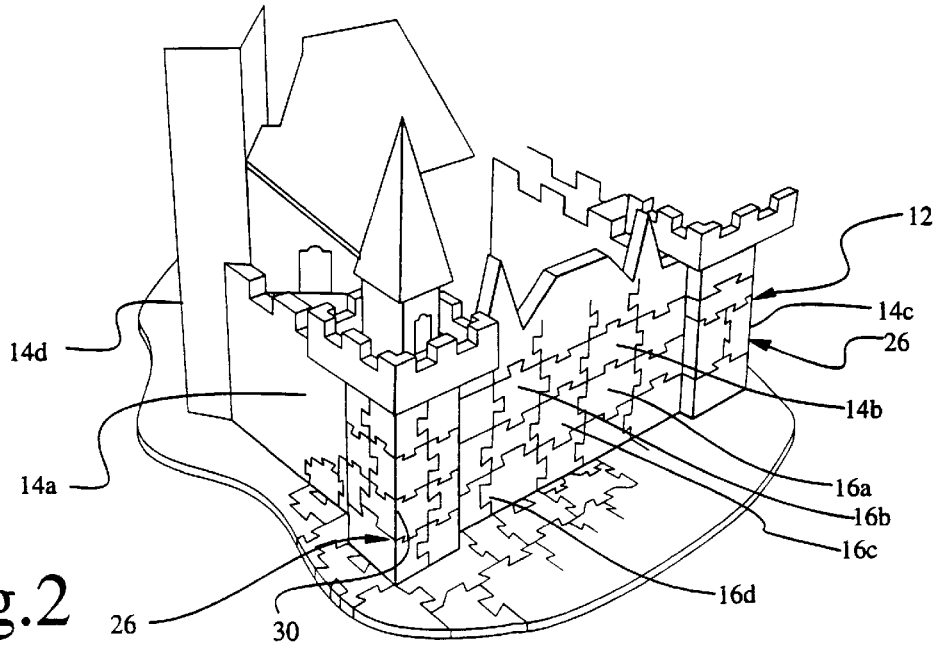
FIG. 2 is a somewhat schematic perspective view of the puzzle of FIG. 1 with portions removed for illustration purposes.
Figure 3A:
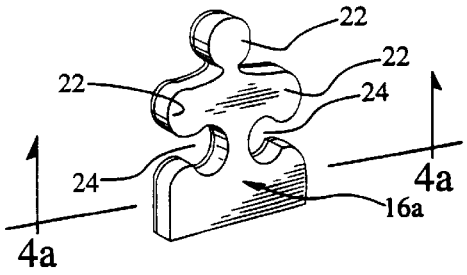
FIG. 3*a* is a perspective view of a wall piece for the puzzle of FIG. 1.
Figure 4A:
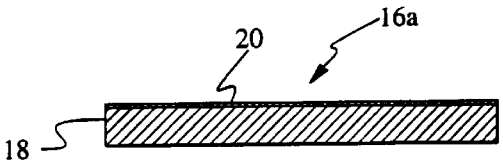
FIG. 4*a* is a cross-sectional view taken on the line 4*a*—4*a* of FIG. 3*a;*

In the illustrations given, and with reference first to FIG. 1, the reference numeral 10 designates generally a three-dimensional jigsaw puzzle for assembly into a building-like structure 12 having walls 14*a,* 14*b,* 14*c,* 14*d,* etc. to be joined at corners thereof (see also FIG. 2). The puzzle 10 includes a plurality of wall pieces 16*a,* 16*b,* 16*c,* 16*d,* etc. capable of interlocking in a plane to form the walls 14*a,* 14*b,* 14*c,* 14*d,* etc. of the building-like structure 12. Each of the wall pieces 16*a,* 16*b,* 16*c,* 16*d,* etc. is formed of a backing material 18 having the necessary characteristics including a thickness dimension for the building-like structure 12 to be self-supporting when the puzzle 10 has been fully assembled (see, also, FIGS. 3*a* and 4*a*). The puzzle 10 is such that the backing material 18 of the wall pieces 16*a,* 16*b,* 16*c,* 16*d,* etc. each have an integrally associated image-bearing outer surface 20 thereon. Each of the wall pieces 16*a,* 16*b,* 16*c,* 16*d,* etc. also has peripheral male and female contours 22 and 24, respectively, capable of interlocking engagement in a plane to form a portion of the wall with complementary male and female contours of adjacent ones of the wall pieces (see, also, FIG. 5). The puzzle 10 further includes at least one corner piece 26 which is capable of joining a pair of walls such as 14*a* and 14*b* at each corner of the building-like structure 12. Each of the corner pieces 26 is also formed of the same backing material 18 as that used for the wall pieces 16*a,* 16*b,* 16*c,* 16*d,* etc., and also includes the appropriate portion of the puzzle 10 in the form of an integrally associated image-bearing outer surface 20 thereon (see, also, FIGS. 3*b* and 4*b*). The puzzle 10 is such that the corner pieces 26 each have a groove 28 formed in the backing material 18 on the side opposite the image-bearing outer surface 20. With this arrangement, the grooves 28 in the corner pieces 26 have a depth dimension sufficient for folding the corner piece 26 to form a corner for the building-like structure 12 (see FIG. 5).

Figure 3B:
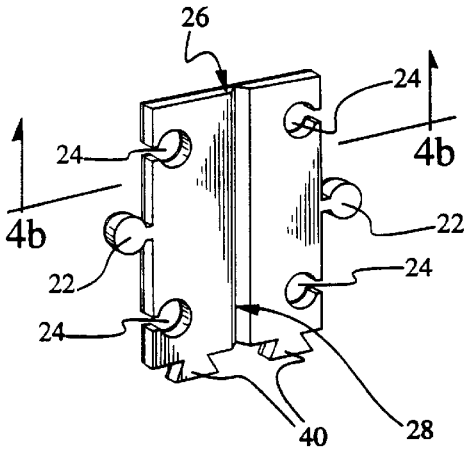
FIG. 3*b* is a perspective view of a corner piece for the puzzle of FIG. 1.
Figure 4B:
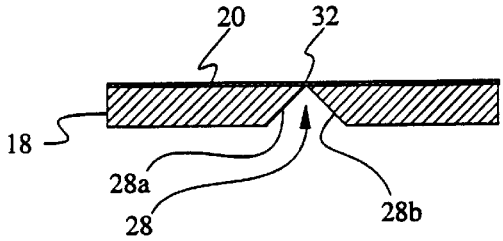
FIG. 4*b* is a cross-sectional view taken on the line 4*b*—4*b* of FIG. 3*b*
Figure 5:
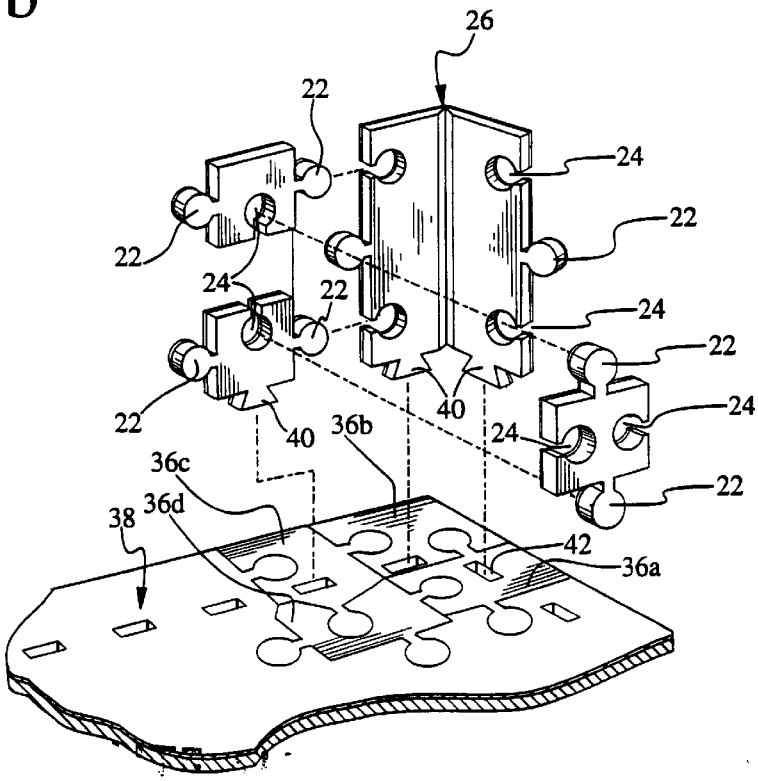
FIG. 5 is a perspective view of assembling a puzzle with the corner piece of FIG. 3*b;*

As will be seen in FIGS. 3*b* and 5, the corner pieces 26 also each have peripheral male and female contours 22 and 24, respectively, capable of interlocking engagement in the planes of the pair of walls such as 14*a* and 14*b* to be joined thereby. It will further be appreciated, by referring to FIGS. 4*b* and 5, that the grooves 28 have a depth dimension sufficient for folding the corner pieces 26 to form the corners for the building-like structure 12 as right-angle corners. It should be appreciated in this connection that the depth dimension for the grooves 28 in the corner pieces 26 is advantageously sufficient to create soft bend or fold lines such as 30 on the image-bearing outer surfaces 20 when folded to form the corners. It will further be appreciated, by referring to FIG. 4*b* in particular, that the grooves 28 are generally V-shaped to define an angle of at least 90° between the intersecting surfaces 28*a* and 28*b* of the backing material 18 defining the grooves 28. In the preferred embodiment, the backing material 18 for the wall pieces 16*a,* 16*b,* 16*c,* 16*d,* etc. and the corner pieces 26 is formed of a polyethylene foam, and the image-bearing outer surfaces 20 are formed of a lithographic sheet laminated to the foam.

In the illustrated embodiment, the three-dimensional jigsaw puzzle 10 will have a plurality of corner pieces 26 for joining a pair of walls such as 14*a* and 14*b* at each of the corners of the building-like structure 12. It will be appreciated from FIG. 4*b* that the grooves 28 have a depth dimension less than the thickness of the backing material 18 so as to form padded hinges as at 32, substantially at the point of the soft bend or fold lines 30. The grooves 28 divide the backing material 18 into first backing member 18*a* and second backing member 18*b*. Advantageously, the corner pieces 26 are formed such that the grooves 28 define an angle in the range of 90° and 130° between the intersecting surfaces 28*a* and 28*b* of the backing material 18 to thereby facilitate the realistic effect achieved with the present invention.

As shown in FIG. 6, the corner pieces 26 are such that they can be folded to form either an inside or an outside corner, as desired, as a result of the unique characteristics that are achieved by forming the grooves 28 as described in greater detail hereinabove.

As illustrated in FIGS. 1 and 2, the building-like structure 12 has at least four walls, 14*a*, 14*b*, 14*c*, 14*d* to be joined at corners and includes one or more corner piece 26 at each of the four corners thereof. It may also be the case that the corner pieces 26 can extend to the full height of the walls 14*a*, 14*b*, 14*c*, 14*d*, thereby requiring only a single corner piece in each of the corners, or, alternatively, and preferably from a puzzle assembly enjoyment viewpoint, there can be provided more than one corner piece in each of the corners with the vertically adjacent corner pieces adapted to be disposed in interlocked engagement by means of cooperation of appropriate male and female contours 22 and 24, respectively. With only a single corner piece in each corner of the building-like structure 12, it is believed that there might be a slightly greater degree of stability in the puzzle 10 when it is fully assembled.

With the present invention, the building-like structure 12 may be provided with a suitable roof 34 and/or towers 35 or like structures that may be assembled in puzzle form or comprise a unitary component or components.

Referring now to FIG. 5, the puzzle 10 also advantageously includes a plurality of base pieces 36*a*, 36*b*, 36*c*, 36*d*, etc., capable of interlocking in a plane to form a puzzle base 38. The wall pieces such as 16*a*, 16*b*, 16*c*, 16*d*, etc., and the corner pieces 26 adjacent the puzzle base 38 have male dovetail joint elements 40 thereon. As also shown, the base pieces such as 36*b* have corresponding male dovetail joint-receiving openings 42 to lockingly receive the elements 40 on the appropriate wall pieces 16*a*, 16*b*, 16*c*, 16*d*, etc., and the corner pieces 26.

Referring now to FIGS. 7 and 8, there is shown an alternative form of corner piece which is generally designated 26'. This corner piece 26' is formed to have the fold line 30' defined by the groove 28'. In addition, the corner piece 26' will be seen to have at least one additional fold line 44 defined by a living hinge.

In this connection, the living hinge 44 is defined by a die-cut score through the backing material 18' to the depth of the image-bearing outer surface 20' of the corner piece 26'. In the embodiment illustrated, the corner piece 26' will actually have a lithographic sheet 20' on each of the oppositely facing surfaces of the polyethylene foam backing material 18' and will include yet another fold line 46. Still more specifically, the one fold line 44 on the corner piece 26' defines a living hinge operating in one direction, and the other fold line 46 on the corner piece 26' defines a living hinge operating in the opposite direction. With this arrangement, the corner piece 26' can be utilized to provide the entirely unique corner for a three-dimensional jigsaw puzzle which has been fully illustrated in FIG. 7.

As also illustrated in FIG. 7, the corner piece 26' can include female contours 24' for interlocking engagement with corresponding male contours on a mating upper corner piece. This was previously suggested hereinabove in connection with the discussion of alternatively utilizing either a single corner piece spanning the full height of the walls or more than one corner piece wherein vertically adjacent corner pieces are lockingly interengaged by means of complementary male and female contours. In other respects, the corner piece 26' will be understood to be identical in terms of how it is assembled to the base 38 and to adjacent wall pieces such as 16*a*, 16*b*, 16*c*, 16*d*, etc.

More specifically, the corner piece 26' will be seen to include male dovetail joint elements 40' adapted for interlocking engagement with the male dovetail joint-receiving openings 42' in the base 38'. It will also be appreciated that the corner piece 26' as well as the wall pieces adapted for interlocking engagement therewith all include suitable complementary male and female contours 22' and 24', respectively. As for the utilization of a lithographic sheet on each of the oppositely facing surfaces 20' of the polyethylene foam 18', the lithographic sheet serves to make it possible to have the oppositely operating living hinges 44 and 46.

In other words, one of the lithographic sheets 20' can be cut along with the polyethylene foam 18' substantially to the other of the lithographic sheets 20' to define one of the living hinges, and the other of the lithographic sheets 20' can be cut along with the polyethylene foam 18' substantially to the one lithographic sheet 20' to define the other of the living hinges.

By reason of the nature of the lithographic sheets, the living hinges 44 and 46 are fully operable while maintaining the integral characteristic of the corner piece 26'.

As for other details of the building-like structure 12, they can take any of a variety of different forms. Thus, it will be understood and appreciated that the three-dimensional jigsaw puzzle 10 illustrated in FIG. 1 has been presented only as an example of one building-like structure of an essentially infinite variety that could be assembled utilizing the unique features of the present invention. For this reason, those skilled in the art will appreciate that the invention is in no way limited to the illustrated embodiments.

In a most highly preferred embodiment, the groove 28 is skived out of the polyethylene foam backing material 18. This produces the padded living hinge effect wherein the corner piece 26 is normally flat so as to be unfolded into a single plane but can easily be folded into a right-angle corner piece for assembly of the puzzle. When the corner piece 26 is folded, the male dovetail joint elements 40 are then easily inserted into the male dovetail joint-receiving openings 42 in the base 38.

In both of the embodiments of the invention which have been illustrated in the drawings, the lithographic sheet 20 is advantageously formed of an 8 pt. lithographic sheet which is laminated to the polyethylene foam backing material 18. It is advantageous in the case of the corner piece 26' for each of the oppositely facing surfaces 20' to have an identical or similar 8 pt. lithographic sheet, or another laminate, glued onto the polyethylene foam backing material 18' with each of the die-cut scores made as previously mentioned in order to achieve a living hinge 44 and 46 capable of a 180° fold. With regard to the grooves 28 and 28' in the corner pieces 26 and 26', respectively, the resulting skive fold may pivot through approximately 270°, i.e., from a right-angle corner to mating contact of the corresponding one of the lithographic sheets 20'.

While the details of the invention are highly advantageous, they can naturally be varied, depending upon the specific requirements for a particular three-dimensional jigsaw puzzle. It will, therefore, be appreciated that the specifics set forth are merely for purposes of illustrating one or more preferred embodiments. In any particular three-dimensional jigsaw puzzle, the specifics may be varied while still taking full benefit of the of the inventive features that have been set forth in detail herein.

While in the foregoing there have been set forth preferred embodiments of the invention, it will be appreciated that the details herein given may be varied by those skilled in the art without departing from the true spirit and scope of the appended claims.

What is claimed is:

1. A puzzle for assembly into a three-dimensional structure having walls to be joined at corners thereof, comprising:

a plurality of wall pieces capable of interlocking to form walls of said structure, each of said wall pieces being formed of a backing material having a thickness dimension sufficient for supporting said structure when assembled, each of said wall pieces having an image-element visible from an outer surface of said structure;

each of said wall pieces also comprising either one of integrally formed peripheral male and female contours capable of interlocking engagement with either one of said integrally formed complementary male and female contours of adjacent ones of said wall pieces to form a portion of said wall;

each of said corners being formed by a plurality of corner pieces capable of joining a pair of walls at corners of said structure, said corner pieces being formed of said backing material of said wall pieces and having image-elements visible from an outer surface of said corner pieces, each of said corner pieces having a groove in said backing material on the side opposite the outer surface of each said corner piece;

the grooves of said corner pieces having a depth dimension sufficient for folding said corner pieces to form one or more corners for said structure.

2. The puzzle of claim 1, wherein each said corner piece has peripheral male and female contours capable of interlocking engagement of said pair of walls to be joined thereby.

3. The puzzle of claim 1, wherein said groove has a depth dimension sufficient for folding each said corner piece to form said corner for said three-dimensional structure as a right angle corner.

4. The puzzle of claim 1, wherein said depth dimension for said groove in each said corner piece is sufficient to create a fold line on said image-element when folded to form said corner.

5. The puzzle of claim 1, wherein said groove is generally V-shaped to define an angle of at least 90° between the intersecting surfaces of said backing material defining said groove.

6. The puzzle of claim 1, wherein said backing material is formed of a polyethylene foam, and said image-element is formed of a lithographic sheet laminated to said foam.

7. A puzzle for assembly into a three-dimensional structure having walls to be joined at corners thereof, comprising:

a plurality of wall pieces capable of interlocking in a plane to form walls of said structure, each of said wall pieces being formed of a backing material having a thickness dimension sufficient for supporting said structure when assembled, each of said wall pieces having an image-bearing outer surface thereon; each of said wall pieces also having either one of integrally formed peripheral male and female contours capable of interlocking engagement in said plane to form a portion of said wall with either one of integrally formed complementary male and female contours of adjacent ones of said wall pieces;

a plurality of corner pieces capable of joining pairs of walls at each of said corners of said structure, each of said corner pieces being formed of said backing material of said wall pieces and also having an image-bearing outer surface thereon, each of said corner pieces having a groove in said backing material on the side opposite the image-bearing outer surface;

each of said corner pieces also having either one of integrally formed peripheral male and female contours capable of interlocking engagement in the pair of walls to be joined thereby;

said grooves having a depth dimension sufficient for folding said corner pieces to form right angle corners, said grooves being generally V-shaped to define an angle of at least 90° between intersecting surfaces of said backing material defining said grooves and said depth dimension being generally sufficient to create fold lines on the image-bearing outer surfaces of the corner pieces when folded to form said corners, said grooves having a depth dimension less than the thickness of said backing material so as to form padded hinges substantially at the point of said fold lines;

at least one of said corner pieces being formed to have said fold line thereon defined by said groove and at least one additional fold line defined by a living hinge.

8. The puzzle of claim 7, wherein said backing material is formed of a polyethylene foam and said image element is formed of a lithographic sheet laminated to said polyethylene foam of said backing material.

9. The puzzle of claim 7 wherein said building-like structure has at least four walls to be joined at corners, including a plurality of corner pieces for each corner of said three-dimensional structure.

10. The puzzle of claim 8 wherein said living hinge is defined by a die-cut score through said polyethylene foam to the depth of said lithographic sheet of said corner piece.

11. The puzzle of claim 10 wherein at least one corner piece has a lithographic sheet on each of oppositely facing surfaces of said polyethylene foam and including two additional fold lines.

12. The puzzle of claim 11 wherein one of said additional fold lines defines a living hinge operating in one direction, and the other of said additional fold lines defines a living hinge operating in the opposite direction.

13. The puzzle of claim 7, including a plurality of base pieces capable of interlocking in a plane to form a puzzle base, said wall pieces and corner pieces adjacent said puzzle base having male dovetail joint means thereon, said base pieces forming said puzzle base having male dovetail joint means-receiving openings to lockingly receive said male dovetail joint means on said wall pieces and said corner pieces.

14. A puzzle for assembly into a three-dimensional structure having walls to be joined at corners thereof, comprising:

a plurality of wall pieces capable of interlocking engagement with one another to assemble walls of said three-dimensional structure, each of said wall pieces including a generally planar backing member having a thickness dimension sufficient for supporting said three-dimensional structure when assembled and an image-bearing outer surface;

each of said wall pieces also comprising at least one joint member capable of interlocking engagement with a complementary joint member of an adjacent wall piece, whereby allowing assembly of walls of said three-dimensional structure;

each of said corners being formed by a plurality of corner pieces each capable of joining a pair of walls at a corner of said three-dimensional structure, said corner pieces each comprising:

a) first and second generally planar backing members;

b) a hinge between said first and second backing members, said hinge allowing said first and second backing members to assume a non-planar condition;

c) an image bearing outer surface, said image bearing outer surface extending over said hinge; and d) integrally formed joint members capable of interlocking engagement when said corner piece is in a non-planar condition with complementary joint members of respective wall pieces.

15. The puzzle of claim 14, wherein said first and second generally planar backing members are integrally formed, said corner piece including a groove between said backing members forming said hinge.

16. The puzzle of claim 15, wherein said groove is generally V-shaped in cross-section.

17. The puzzle of claim 14, wherein said first and second generally planar backing members are made of polymeric foam.

18. The puzzle of claim 14, wherein said corner piece includes a lithographic film forming said image bearing outer surface.

19. The puzzle of claim 18, wherein said lithographic film is bonded with said backing members in a face-to-face relationship.

20. The puzzle of claim 19, wherein said lithographic film is adhesively bonded with said backing members.

21. The puzzle of claim 14, wherein the joint members of said corner piece are selected from the group consisting of female joint member, male joint member, and combination thereof.

22. The puzzle of claim 14, wherein said corner piece is capable of acquiring a right angle configuration.

* * * * *